US010345025B2

(12) United States Patent
Visin

(10) Patent No.: US 10,345,025 B2
(45) Date of Patent: Jul. 9, 2019

(54) OSCILLATING AND GYRATING STIR STICK FOR AN ICE CONTAINER

(71) Applicant: WHIRLPOOL CORPORATION, Benton Harbor, MI (US)

(72) Inventor: Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 13 days.

(21) Appl. No.: 15/637,326

(22) Filed: Jun. 29, 2017

(65) Prior Publication Data

US 2017/0299245 A1 Oct. 19, 2017

Related U.S. Application Data

(63) Continuation of application No. 13/563,985, filed on Aug. 1, 2012.

(51) Int. Cl.

| | |
|---|---|
| ***F25C 5/04*** | (2006.01) |
| ***F25C 5/182*** | (2018.01) |
| ***F25C 5/20*** | (2018.01) |

(52) U.S. Cl.

CPC ..... *F25C 5/04* (2013.01); *F25C 5/182* (2013.01); *F25C 5/22* (2018.01); *F25C 2500/08* (2013.01)

(58) Field of Classification Search

CPC .... F25C 5/04; F25C 5/182; F25C 5/22; F25C 2500/08

See application file for complete search history.

(56) References Cited

U.S. PATENT DOCUMENTS

| | | | | | |
|---|---|---|---|---|---|
| 856,295 | A * | 6/1907 | Prindle | A47J 43/046 | 241/199.12 |
| 3,677,100 | A * | 7/1972 | Kajiwara | B01F 7/30 | 366/287 |
| 7,111,473 | B2 * | 9/2006 | Chung | F25C 5/007 | 241/DIG. 17 |
| 7,318,323 | B2 * | 1/2008 | Tatsui | F25C 1/10 | 62/320 |
| 2006/0196213 | A1 * | 9/2006 | Anderson | F25C 5/22 | 62/344 |
| 2006/0207270 | A1 * | 9/2006 | Voglewede | F25C 5/046 | 62/135 |
| 2009/0133428 | A1 * | 5/2009 | An | F25C 5/046 | 62/320 |
| 2009/0205358 | A1 * | 8/2009 | Smtih | F25C 5/005 | 62/457.1 |

* cited by examiner

*Primary Examiner* — Filip Zec
(74) *Attorney, Agent, or Firm* — Price Heneveld LLP

(57) ABSTRACT

A refrigerator is provided that includes an ice making system, that generally includes an ice maker for making ice, and an ice container for holding the formed ice. The ice making system may be positioned anywhere within the refrigerator, and it may be a modular ice system. The shape of the ice container limits the amount of useable space taken up by the system. The ice container includes a stir stick positioned within the ice container. The stir stick is configured to rotate and oscillate in a direction generally perpendicular to the axis of rotation of the stir stick to provide movement of the stir stick into the full area of the ice container. The rotation and oscillation of the stir stick prevents ice from melting and clumping in the corners of the ice container, while also aiding in directing the ice towards a dispensing aperture of the ice container.

20 Claims, 5 Drawing Sheets

OSCILLATING AND GYRATING STIR STICK FOR AN ICE CONTAINER

CROSS-REFERENCE TO RELATED APPLICATIONS

The present application represents a continuation application of and claims priority to U.S. patent application Ser. No. 13/563,985 entitled "OSCILLATING AND GYRATING STIR STICK FOR AN ICE MAKER" filed Aug. 1, 2012, now abandoned.

FIELD OF THE INVENTION

The present invention relates generally to the field of refrigerators. More particularly, but not exclusively, the invention relates to an apparatus for preventing ice clumps and breaking up formed ice clumps in an ice container.

BACKGROUND OF THE INVENTION

Ice makers may be included with refrigerators, or may be stand-alone units. In general, the ice maker includes a water source, a cooling source, a mold, and an ejecting mechanism. Water is added to the mold, and the cooling source removes heat from the water to lower the temperature below freezing, at which time ice cubes are formed. Once the cubes have formed, the ejecting mechanism operates to remove or eject the formed cubes from the molds, at which point new water can be added and the process repeated.

The ejected ice cubes are generally directed towards an ice container or ice storage bin. In refrigerators and in stand-alone units, the ice container is located generally adjacent the ice maker so that the formed ice cubes do not have to travel a long distance from the ice maker. Furthermore, the cooled air of the cooling source may be used to direct cold air to the ice container to keep the ice cubes in the ice container below freezing to prevent the cubes from melting.

In a refrigerator, the ice maker and ice container may be positioned on the inside of a refrigerator compartment or freezer compartment door, with the ice maker generally positioned above the ice container such that gravity causes the formed ice cubes to fall from the ice maker to the ice container. The cooling source in a refrigerator may be cold air that is directed from the freezer compartment to the ice maker. The below-freezing air from the freezer removes enough heat to freeze the water in the ice molds. The same air may also be passed into the ice container to prevent the cubes from melting.

However, as the amount of cubes accumulate in the ice container, it becomes more difficult to ensure that all of the cubes are at a temperature to prevent melting. If air is passed into the container, it may not reach cubes that are located below other cubes. Warm air may also be introduced to the ice container if a door is opened or the ice container is opened to retrieve ice from the container. In any sense, the cubes in the container may experience some melting and refreezing. The melting and refreezing of the cubes can cause multiple cubes to freeze together, forming ice clumps. The ice clumps are too large to fit through a dispenser opening, and therefore, it is important to provide means to prevent clumping, or to break up the clumps.

Stir sticks have been added to ice containers to aid in preventing and breaking up ice clumps. The stir sticks are configured to rotate within an ice container to move the cubes and to direct the cubes towards a dispensing area.

However, the size and shape of ice containers do not make it feasible for the stir sticks to reach the full area within the containers. Therefore, there are areas within the container that still include conditions that allow the formation of ice clumps.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide an apparatus and method of preventing the formation of ice clumps in an ice container.

It is yet another object, feature, and/or advantage of the present invention to provide an apparatus and method for breaking up ice clumps that have formed in an ice container.

It is still another object, feature, and/or advantage of the present invention to provide an apparatus that includes a stir stick that oscillates while rotating in an ice container.

It is a further object, feature, and/or advantage of the present invention to provide an apparatus that provides a stir stick that is able to extend into the full area of an ice container.

It is still a further object, feature, and/or advantage of the present invention to provide an ice making system including a stir stick that includes bends and that is connected to a cam to oscillate and rotate.

It is another object, feature, and/or advantage of the present invention to provide an apparatus that allows for different configurations of ice containers to be used.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a cabinet and a door for providing access to within the cabinet. An ice maker is operably connected to the cabinet. An ice container is positioned adjacent the ice maker. A stir stick is positioned within the ice maker, and is configured to oscillate while rotating in a direction generally perpendicular to the axis of rotation of the stir stick.

According to another aspect of the invention, an ice making system is provided. The ice making system includes an ice maker. An ice container is located adjacent the ice maker and comprises first, second, third, and fourth walls. A stir stick is positioned within the ice container and is configured to oscillate while rotating in a direction generally perpendicular to the axis of rotation of the stir stick.

According to yet another aspect of the present invention, a method of breaking ice clumps and preventing freeze-up of ice in an ice container is provided. The method includes providing an ice container including a stir stick operably connected to the ice container. The stir stick extends within the ice container and comprises a plurality of bends along its length. The stir stick is rotated within the ice container, while also oscillating or gyrating while rotating to extend the bends of the stir stick to reach the full area within the ice container.

DETAILED DESCRIPTION OF THE PREFERRED EMBODIMENTS

Figure 1:
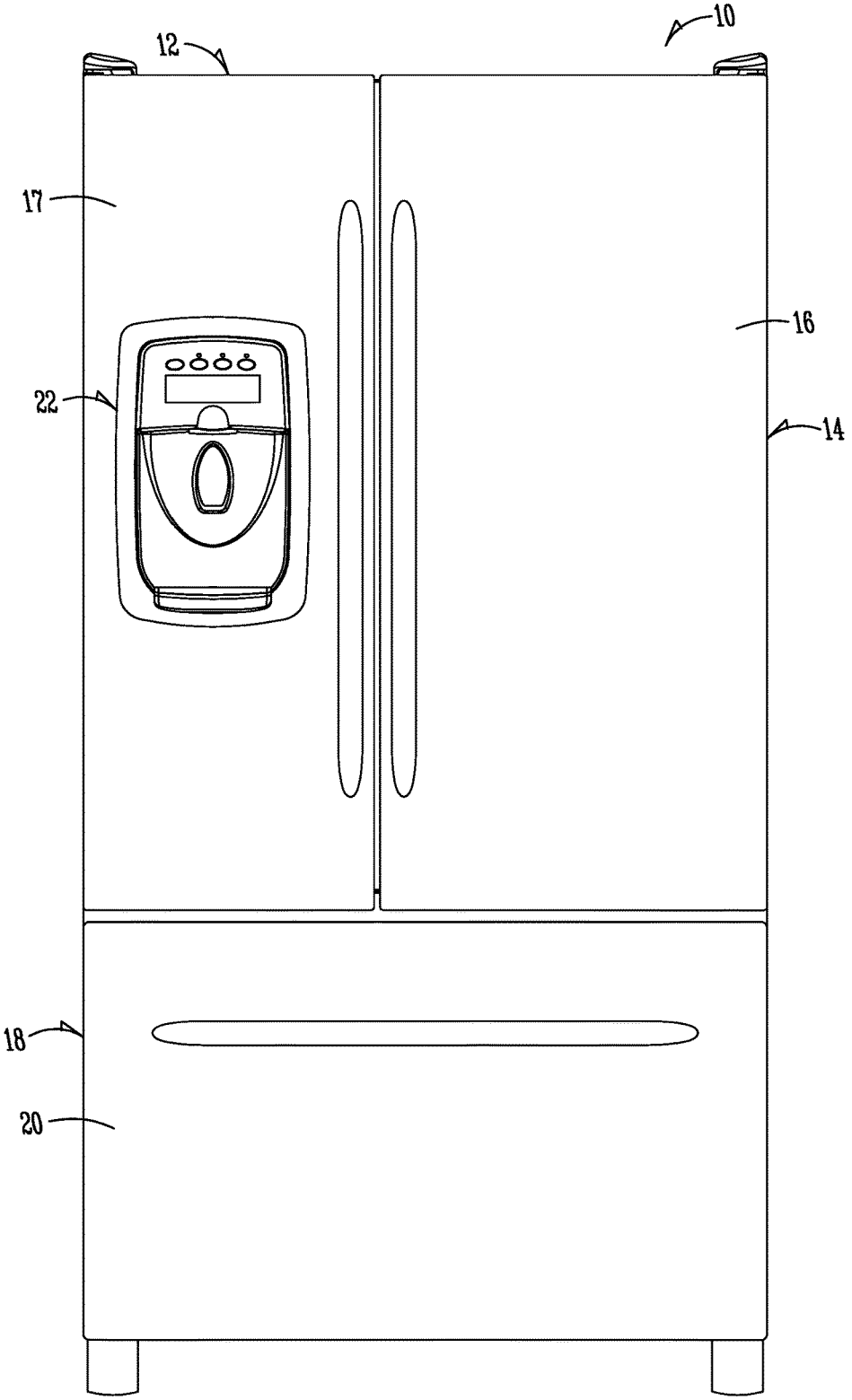
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 16. A dispenser 22 is positioned on one of the doors 17 of the refrigerator compartment 16. The dispenser 22 may be a water dispenser, ice dispenser, other beverage dispenser, or some combination thereof. Furthermore, the dispenser 22 may be placed on any door 16, 17, 20 of the refrigerator 10, or the dispenser 22 may be placed within one of the compartments of the refrigerator 10. For example, the dispenser 22 may be placed at one of the interior walls of the refrigerator compartment 16, thus being part of the cabinet 12. The placement of the dispenser 22 is not to limit the present invention. Positioned generally below the refrigerator compartments 14 is a freezer compartment 18. A freezer door 20 provides access to the freezer compartment 18. The freezer door 20 of FIG. 1 is shown as a drawer-type door. However, the present invention contemplates that the freezer door 20 may be a drawer or hinge door for providing access to the interior of the freezer compartment 18.

Figure 2:
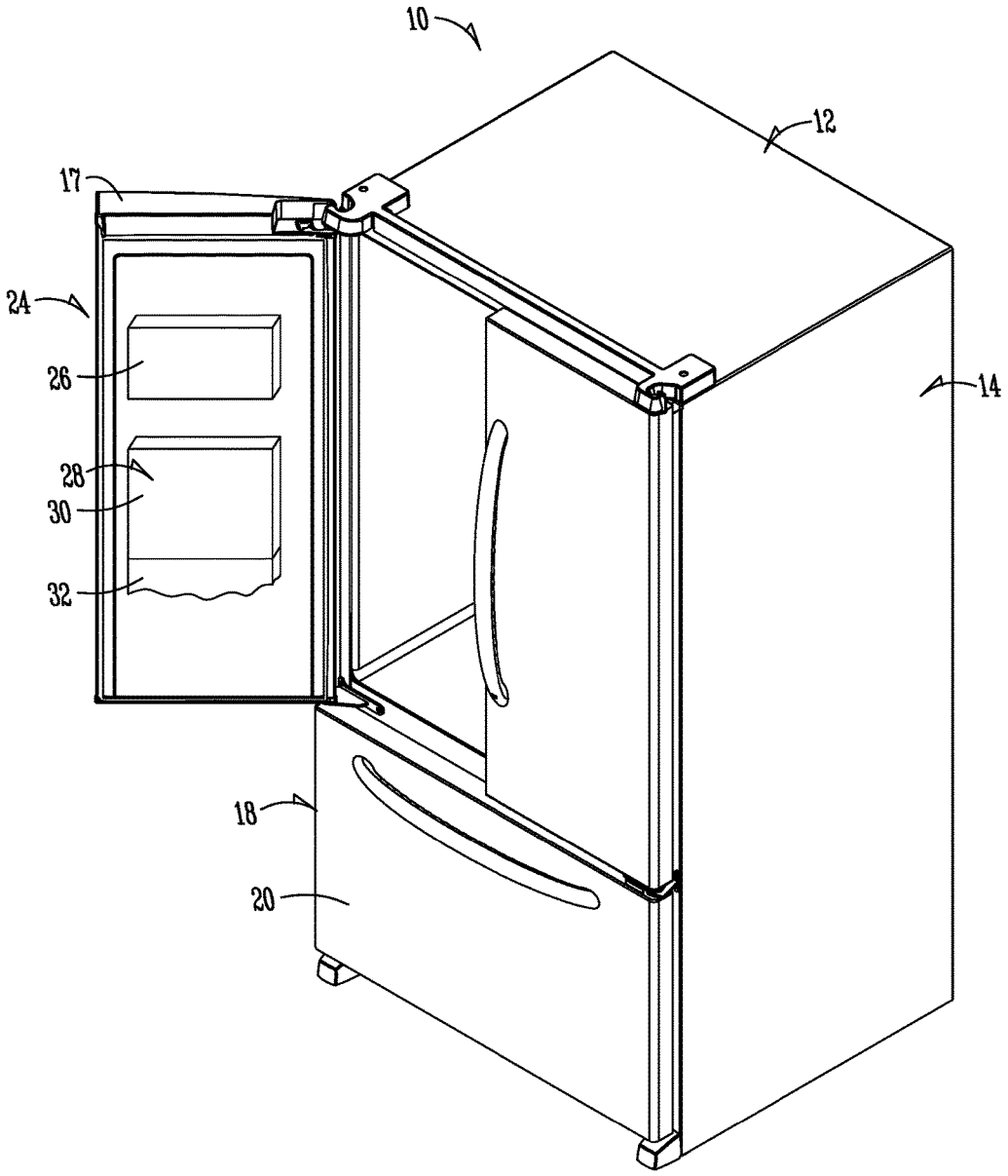
FIG. 2 is a perspective view of the refrigerator of FIG. 1 with the refrigerator doors open and showing an ice maker and ice container.

It should also be appreciated, that while FIGS. 1 and 2 show a bottom mount style refrigerator 10, the present invention contemplates that any style of refrigerator be included as part of the invention. The figures merely depict one example of a type of refrigerator that can be used with the present invention.

FIG. 2 is a perspective view of the bottom mount refrigerator 10 of FIG. 1 having the refrigerator door 17 opened and the refrigerator door 16 removed to show an interior of the refrigerator 10. In addition, the freezer door 20 is shown to be a drawer that can be slid open to provide access to the freezer compartment 18. FIG. 2 shows an ice making system 24, which is operably connected to a dispenser 22 of the refrigerator 10. As shown in FIG. 2, the ice making system 24 is positioned on the inside of the refrigerator door 17. However, as mentioned above regarding the dispenser 22, the ice making system 24 can be positioned generally anywhere with respect to the refrigerator 10. For example, the ice making system can be positioned in or at an upper portion of the refrigerator compartment 14, on a side wall of the refrigerator compartment 14, or even possibly in the freezer compartment 18. The location of the ice making system 24 is not to be limiting to the present invention.

The ice making system 24 shown in FIG. 2 includes an ice maker 26 and an ice container 28. The ice maker 26 can be any style or configuration of ice maker that produces ice cubes (not shown). The ice container 28 is operably connected to the ice maker 26 such that ice cubes made in the ice maker 26 are dispensed or directed into the ice container 28. The size of the ice container 28 should be sufficient enough to contain or hold an amount of ice sufficient for a user or owner. Furthermore, it should be contemplated that both the ice maker 26 and the ice container 28 may be removed from the refrigerator 10. Thus, the present invention contemplates that the ice making system 24 be a modular ice making system. Furthermore, it should be appreciated that only the ice container 28 may be removable from the refrigerator 10. Also shown in FIG. 2, the ice container 28 generally includes an upper portion 30 and a lower portion 32. The portions will be discussed in greater detail below. However, the upper and lower portions 30, 32 of the ice container 28 generally are constructed such that they comprise a single unit, and are not removed separately when the ice container is removed from the refrigerator 10.

Figure 3:
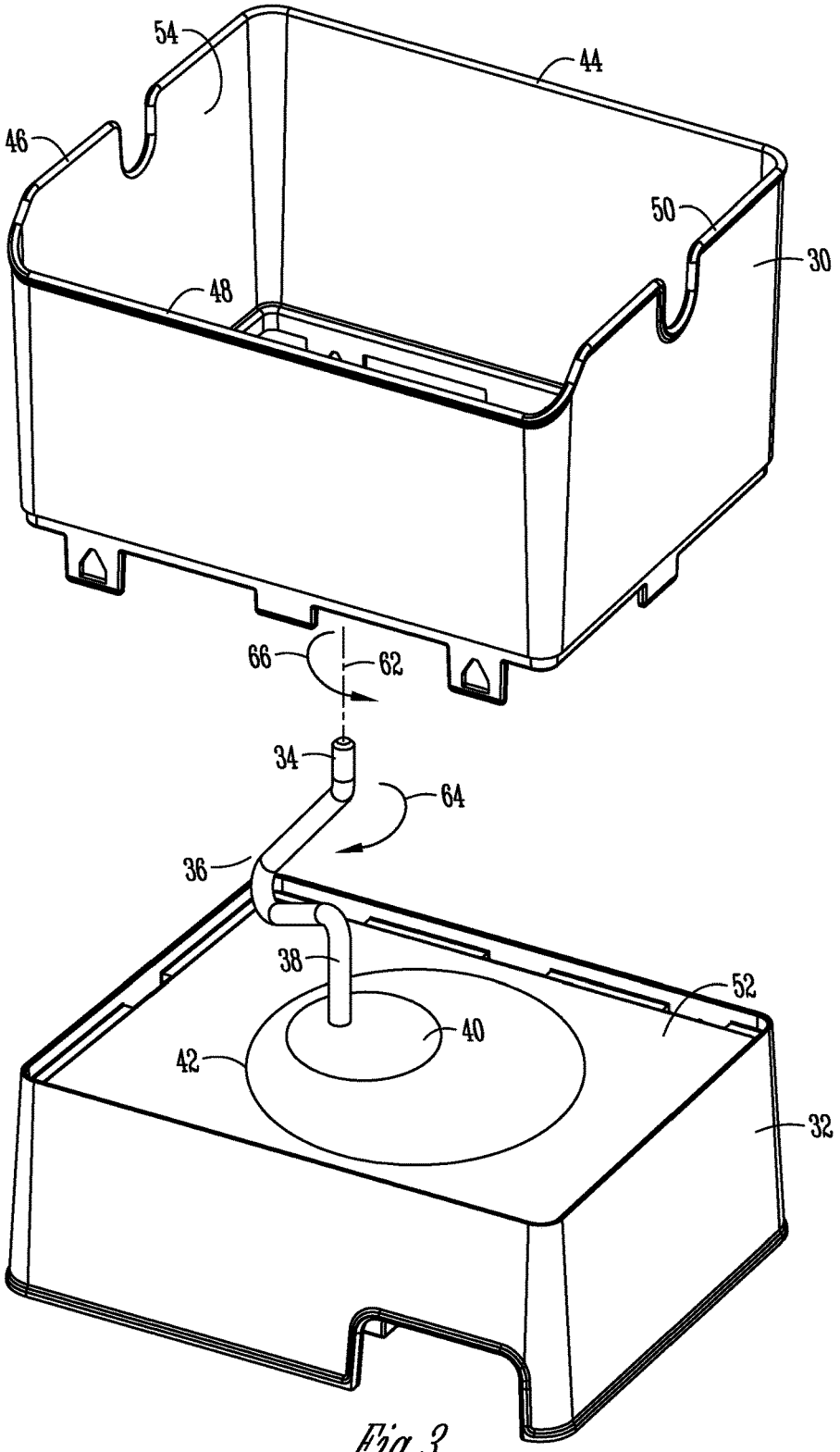
FIG. 3 is a partial exploded view of an ice container according to the present invention.

FIG. 3 is a partial exploded view of an ice container 28 according to the present invention. As shown in FIG. 3, the ice container 28 is generally a rectangular-shaped container. The rectangular shape of the ice container 28 of the present invention allows for a slimmer ice container 28 that will take up less useable space within the refrigerator 10. However, the present invention contemplates that the ice container 28 comprises generally any shape, including but not limited to oval shapes or any other geometrical shape that may allow for the ice container to hold a predetermined amount of ice, while taking up the least amount of space as possible within the refrigerator. In addition, the shape of the lower or bottom portion 32 of the ice container 28 may be the same or different than the shape of the upper portion 30 of the ice container 28. However, the upper and lower portions 30, 32 should be connectable in some manner Positioned within the ice container and generally near the center of the ice container is a stir stick 34. The stir stick is a rod-shaped member that can be rotated to move or displace the ice within the ice container 28. The movement of the ice cubes in the ice container 28 aids in preventing the ice cubes from melting or clumping, while also providing or aiding movement of the cubes towards an aperture 42 in the container 28 that dispenses the ice cubes from the ice container into a cup or other container. The stir stick 34 includes one or more bent portions 36 along the length of the stir stick. The bent portion provides greater area of the stir stick 34 as it rotates in the ice container 28. Furthermore, the stir stick 34 includes a generally vertical portion at the bottom 38 of the stir stick for extending into the bottom portion 32 of the ice container 28 and connecting to a motor 56. The motor may be any type of motor that can attach to the stir stick to provide rotation of the stir stick within the ice container 28.

The upper portion 30 of the ice container 28, as shown in FIG. 3, includes a first wall 44, second wall 46, third wall 48, fourth wall 50, and a bottom floor or wall 52, with corners 54 formed at the intersections of the walls. The bottom wall 52 may actually be part of the bottom or lower member 32 of the ice container 28. The bottom wall 52 includes the aperture 42 for dispensing the ice, and therefore, may include a crusher or crushing mechanism 40 positioned therein. As noted above, the bottom 38 of the stir stick 34 may extend through the aperture 42 as well to connect to the motor or other rotating means. While the stir stick is shown to be positioned generally in the center of the bottom wall 52, it should be appreciated that the stir stick can be positioned anywhere in the bottom wall to provide for the greatest amount of reach of the bent portions 36 of the stir stick 34.

While the stir stick 34 is configured to rotate, rotation alone may not allow for the bent portions 36 of the stir stick 34 to reach into the corners 54 of the ice container 28. Therefore, the ice at this location may begin to melt and/or clump together. Thus, the present invention contemplates that the stir stick 34 may oscillate or gyrate in the direction generally shown by the arrow 64 as well as or at the same time as rotating as shown in the direction of the arrow 66 of FIG. 3. The gyration of the stir stick 34 is generally in a direction that is perpendicular to the rotational movement of the stir stick within the ice container 28. Thus, the combined rotating and oscillating of the stir stick will allow the bent portion 36 of the stir stick to reach into the full area within the container 28, including the corners 54.

Figure 4:
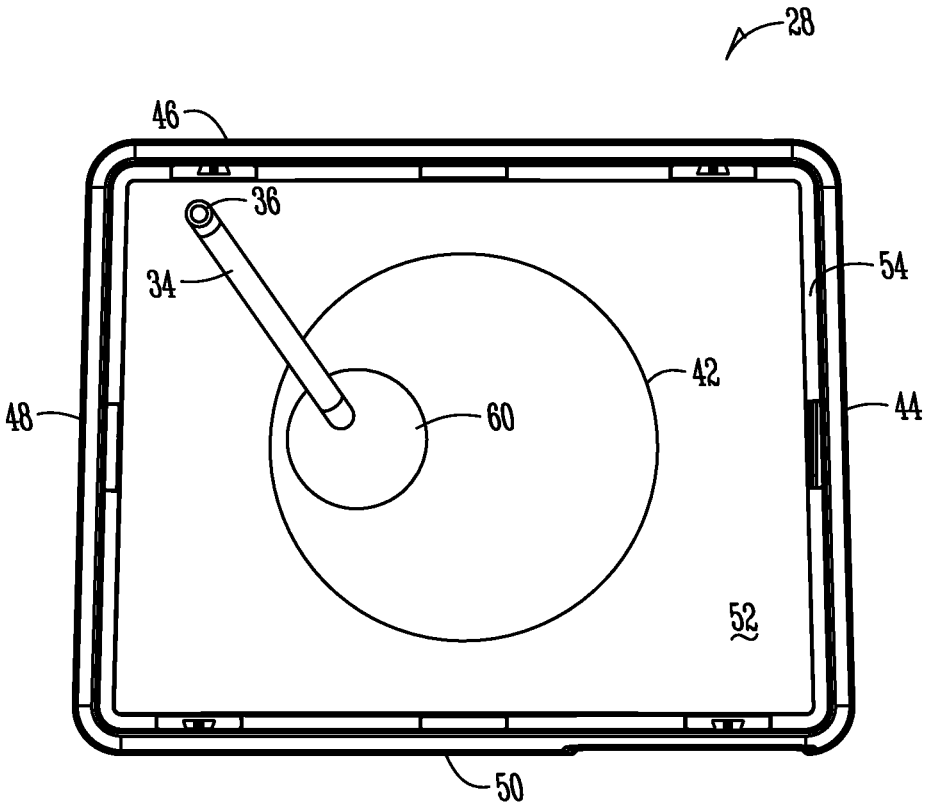
FIG. 4 is a top plan view of the ice container of FIG. 3.

The reach of the stir stick 34 into a corner 54 of the ice container 28 is shown in FIG. 4, which is a top view of the ice container 28 of the present invention. While the stir stick 34 includes an axis 62, the rotation of the stir stick is generally about said axis 62. However, the present invention contemplates the inclusion or the use of one or more cams 60, as shown in FIG. 4. The cams provide for the oscillation or gyration of the stir stick 34 while the stir stick is rotating about said axis 62 to add another dimensional movement of the stick. The movement may be said to be linear, as opposed to the rotational movement. One or more cams 60 may be positioned at the motor shaft 58 or the bottom 38 of the stir stick 34. The present invention also contemplates the use of multiple cams 60 with the multiple cams positioned all at the motor shaft, all at the stir stick, or some combination thereof at the motor shaft and stir stick to provide the appropriate gyration or oscillation (linear movement) of the stir stick 34 to reach into the corners 54 of the ice container 28.

As shown in FIG. 4, the ice container includes a cam 60 attached to the motor shaft 58 of the motor 56. The cam has a motor shaft aperture 63 at the center of the cam 60, and a stir stick aperture 61 positioned outwardly from the central aperture. The stir stick aperture 61 allows the stir stick to attach to the cam 60. The rotation of the motor shaft 58 by the motor 56 will also rotate the cam 60. The rotation of the cam will cause the stir stick to rotate as well. A set of gears may be positioned also connected to the motor shaft 56 with the gears connected to the motor shaft and operatively connected to the bottom of the stir stick. The rotation of the motor shaft could cause the gears to rotate, which will provide the rotational movement as shown by the arrow 66 of the stir stick 34. However, as the motor shaft 56 is also rotating the cam, the cam will cause the stir stick to gyrate or oscillate as the stir stick is rotating. This is the direction shown by the arrow 64 in FIG. 3. Thus, the stir stick 34 will be both rotating about its axis 62 while also gyrating in a direction perpendicular to the rotation and according to the shape of the cam 60 and location of the stir stick aperture 61 in the cam 60. Thus, the multiple sources of movement for the stir stick will cause rotation and gyrating of the stir stick to allow the bends of the stir stick to reach into the full areas of the ice container 28, thus preventing clumps of ice from melting together. The movement of the stir stick will also aid in directing ice from the full area of the ice container to the dispensing aperture in the bottom wall 52 of the ice container.

As described, the assembly may include multiple gears to aid in the rotation and gyration of the stir stick 34. A gear can be placed or attached to the motor shaft 58. A second gear can be attached at the bottom 38 of the stir stick 34, with the teeth of the gears in communication with one another. As the motor 56 rotates its shaft 58, the rotation of the first gear will provide rotation to the second gear, which will in turn rotate the stir stick 34. As the stir stick 34 and/or motor shaft 58 may also be connected to a cam 60, the motor shaft 58 rotation will also cause the stir stick 34 to move in a generally linear direction perpendicular to the rotation. This linear movement will move the stir stick 34 into the corners 54 and at the walls 44, 46, 48, 50 of the ice container 28. However, other means of providing linear movement (gyration/oscillation) to the stir stick 34 are contemplated. Furthermore, a speed reducing gear train may be used with the motor 56 to provide multiple rotations of the stir stick 34 while in the corner 54 of the container 28. Thus, the gear train would create a faster rotation of the stir stick 34 as compared to the rotation of the cam 60, which would provide more oscillation for the stir stick 34 in the corners.

Figure 5:
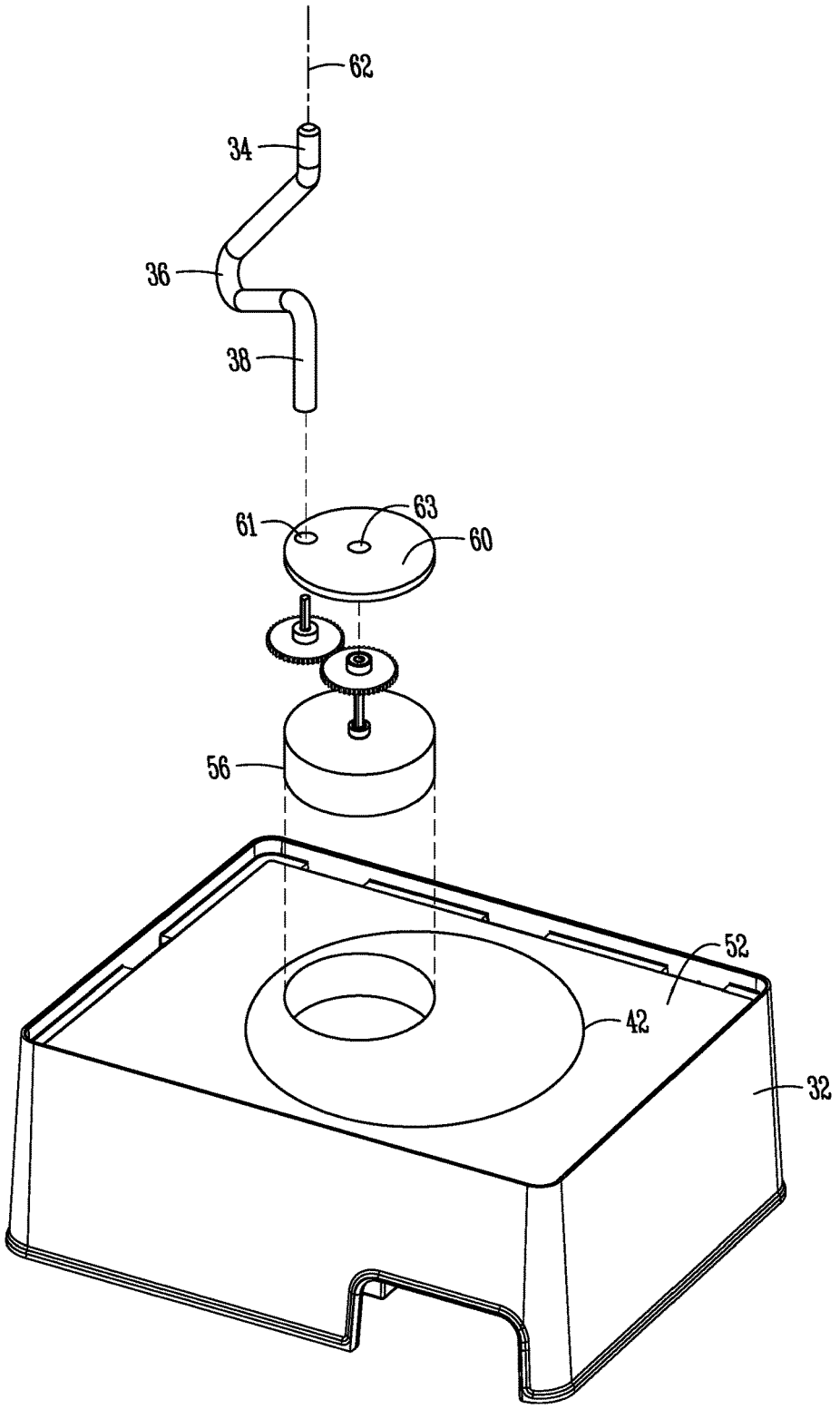
FIG. 5 is an exploded view of the ice container of FIG. 3.

FIG. 5 is an exploded view of the ice container 28 of FIGS. 3 and 4, with the upper portion 30 of the container 28 generally removed. FIG. 5 shows some of the components of the present invention. For example, FIG. 5 shows the stir stick aperture 61 of the cam 60, and also the motor shaft aperture 63 of the cam 60. As noted above, the motor shaft aperture 63 allows the cam 60 to be attached to the motor shaft 58 of the motor 56. The stir stick aperture 61 provides for a connection point for the bottom portion 38 of the stir stick 34. FIG. 5 does not show the gears, as discussed above, which can provide rotation from the motor shaft 58 to the stir stick 34 to provide the rotation of the stir stick 34 about the stir stick axis 62. As discussed above, the configuration of the cam 60, including stir stick and motor apertures 61, 63 may be different than that shown in FIG. 5, with the configurations dependent upon the shape of the ice container, shape of the stir stick 34, amount of movement required or desired for the stir stick, and the like. Thus, the present invention should not be limited by the exact configuration of the stir stick and cam shown in the Figures, and is intended to include generally any configuration of stir stick, cam, and motor that would provide for rotation and gyration or oscillation of the stir stick within the ice container.

To break ice clumps and to prevent freeze up of ice in the ice container 28, the location of the ice container 28 and ice making system 24 should be determined. Thus, the location of the ice making system 24 may determine the shape of the ice container 28. As noted above, the shape of the ice container shall be such that the least amount of useable space within the refrigerator 10 is used by the ice container. Once the shape of the ice container 28, and more particularly the upper portion 30 of the ice container 28, has been determined, the shape 34 of the stir stick should be determined. The shape of the stir stick 34 will be determined on the shape of the ice container, such that the bends 36 of the stir stick 34 shall reach as great amount of area within the ice container as possible. Next, the number and configuration of cam(s) 60 should be determined to work with the stir stick 34 to provide the rotation and gyration of the stir stick 34 to reach the full amount of area within the ice container 28. Thus, the configuration of cam apertures, shape of cam, and number of cams should be determined. Next, it should be determined whether to include a gear system within the motor 56, cam 60, and stir stick 34 to provide additional rotation for the stir stick 34. Once these factors have been determined, the ice container can be assembled. The ice container assembly 28 should be tested to ensure that the motor, gears, cams, and stir stick provide movement to the stir stick such that the stir stick is able to reach into the corners 54 of the ice container. Therefore, the stir stick should be rotated within the ice container while also being oscillated or gyrated to extend the stir stick, including the bends of the stir stick to reach the full area within the ice container.

The foregoing description has been presented for purposes of illustration and description, and is not intended to be an exhaustive list or to limit the invention to the precise forms disclosed. It is contemplated that other alternative processes obvious to those skilled in the art are considered to be included in the invention. The description is merely examples of embodiments. For example, the shape of the stir stick 34 may be varied depending on the shape of the ice container. Furthermore, the location of the motor, stir stick, cams, apertures, and the like may also be varied according to the size and shape of the ice container. In addition, the number of cams and configurations of cams may be varied to provide the stir stick with the greatest amount of movement within the ice container. It should be appreciated that the configuration of the stir stick, cams, gears, and motor within the ice container as described above are but one possible configuration for providing oscillation, gyration, and rotation of the stir stick within the ice container. It is understood that many other modifications, substitutions, and/or additions may be made, which are within the intended spirit and scope of the invention. From the foregoing, it can be seen that the present invention accomplishes at least all of the stated objections.

What is claimed is:

1. A refrigerator, comprising:

a cabinet;

at least one door for providing access to within the cabinet;

an ice maker for making ice operably connected to the cabinet;

an ice container adjacent the ice maker, the ice container comprising at least one corner, a bottom wall, and at least one side wall;

a cam having a first axis of rotation;

a stir stick operably connected to the cam, the stir stick having a second axis of rotation at a location positioned outwardly from the first axis of rotation, the stir stick comprising a bent portion along its length protruding outwardly from the second axis of rotation;

a motor operably connected to the cam to rotate the cam about the first axis of rotation in a first direction of rotation;

a gear train operably connected to the stir stick and configured to rotate the stir stick about the second axis of rotation in a second direction of rotation, wherein the second direction of rotation is opposite the first direction of rotation;

wherein the combination of the rotation of the cam and the rotation of the stir stick is configured to oscillate the bent portion of the stir stick in a direction substantially perpendicular to the first axis of rotation as the stir stick rotates within the ice container; and wherein oscillating the bent portion of the stir stick moves the bent portion of the stir stick into and out of the at least one corner of the ice container without contacting the at least one side wall.

2. The refrigerator of claim 1, wherein the stir stick includes a substantially vertical portion proximate to the bottom wall of the ice container.

3. The refrigerator of claim 1, wherein the first axis of rotation is positioned at a center of the ice container.

4. The refrigerator of claim 1, wherein the ice container is rectangular-shaped.

5. The refrigerator of claim 1, wherein the gear train is configured to provide multiple rotations of the stir stick relative to a rotation of the cam.

6. The refrigerator of claim 1, wherein the second axis of rotation is vertical.

7. The refrigerator of claim 2, wherein the substantially vertical portion of the stir stick extends through an aperture in the bottom wall of the ice container.

8. The refrigerator of claim 1, wherein the stir stick is configured to reach a full area of the ice container to stop freeze-up of ice cubes in the ice container.

9. The refrigerator of claim 1, wherein the path of the bent portion of the stir stick as it moves within the ice container is a hypocycloid path.

10. An ice making system, comprising:

an ice maker;

an ice container adjacent the ice maker, the ice container comprising at least one wall;

a cam having a first axis of rotation in a first rotational direction;

a stir stick operably connected to the cam, the cam configured to rotate the stir stick about a second axis of rotation in a second rotational direction, wherein the first rotational direction is opposite the second rotational direction, and wherein the cam and the stir stick are configured such that rotation of the cam about the first axis of rotation and the rotation of the stir stick about the second axis of rotation causes a bent portion of the stir stick to oscillate in a direction substantially perpendicular to the first axis of rotation, the bent portion of the stir stick oscillating into at least one corner of the ice container and away from the at least one wall as the bent portion of the stir stick moves within the ice container.

11. The ice making system of claim 10, further comprising:

a bottom member adjacent the ice container.

12. The ice making system of claim 11, further comprising:

a motor positioned within the bottom member and operably connected to the cam to provide rotation of the cam, the rotation of the cam oscillating the bent portion of the stir stick.

13. The ice making system of claim 12, further comprising:

a gear train configured to provide multiple rotations of the stir stick relative to a rotation of the cam.

14. The ice making system of claim 13, wherein the stir stick further comprises a plurality of bends where at least one of the plurality of bends of the stir stick is configured to extend into the at least one corner of the ice container.

15. The ice making system of claim 14, wherein the stir stick comprises a substantially vertical portion extending into the bottom member.

16. The ice making system of claim 10, wherein the path of the bent portion of the stir stick as it moves within the ice container is a hypocycloid path.

17. A method of breaking ice clumps and preventing freeze-up of ice in an ice container, comprising:

providing an ice container including a stir stick with at least one bend, wherein the stir stick is operably connected to a cam at a location positioned outwardly from a first axis of rotation of the cam in a first direction of rotation, the stir stick positioned within the ice container;

rotating the stir stick about a second axis of rotation in a second direction of rotation while rotating the cam about the first axis of rotation in the first direction, wherein the first direction of rotation is opposite the second direction of rotation, and wherein the at least one bend of the stir stick oscillates into at least one corner of the ice container and away from at least one wall of the ice container as the stir stick and the cam rotate.

18. The method of claim 17, wherein:

providing an ice container includes providing an ice container that is rectangular-shaped.

19. The method of claim 17, further comprising:

operating a motor positioned within a bottom member of the ice container, wherein the motor is operably connected to the cam to provide rotation of the cam.

20. The method of claim 19, further comprising:

using a gear train to provide multiple rotations of the stir stick relative to a rotation of the cam.

* * * * *